US005134734A

United States Patent [19]

Bozino

[11] Patent Number: 5,134,734

[45] Date of Patent: Aug. 4, 1992

[54] CRIB WITH POSITIONABLE AND SLIDING RAILINGS

[75] Inventor: Pierangelo Bozino, Milan, Italy

[73] Assignee: Mibb, S.r.l., Italy

[21] Appl. No.: 739,845

[22] Filed: Aug. 2, 1991

[30] Foreign Application Priority Data

May 22, 1991 [IT] Italy ..... MI 91U00438

[51] Int. Cl.[5] ..... A47D 7/02

[52] U.S. Cl. ..... 5/100; 4/428

[58] Field of Search ..... 5/93.1, 100, 428

[56] References Cited

U.S. PATENT DOCUMENTS

| | | | |
|---|---|---|---|
| 3,345,653 | 10/1967 | Mixon | 5/100 |
| 3,590,403 | 7/1971 | Mixon | 5/100 |
| 4,530,528 | 7/1985 | Shamie | 5/100 |
| 4,768,243 | 9/1988 | Waples | 5/100 |

FOREIGN PATENT DOCUMENTS

| | | | |
|---|---|---|---|
| 853898 | 11/1960 | United Kingdom | 5/100 |

*Primary Examiner*—Michael F. Trettel

*Attorney, Agent, or Firm*—Kirschstein, Ottinger, Israel & Schiffmiller

[57] ABSTRACT

Crib with positionable and sliding railings, in which on the mutually confronting sides of the headboards, the headboards being intended to receive a sliding railing, a shaped slide bar is fixed, being provided with fixing holes and with holes receiving the end of a fixing rod movably accommodated in the outer solid piece of wood of the railing and pressed by a spring toward the shaped bar for guiding and positioning, and in which the fixing rod is provided with an operating knob at its free end.

9 Claims, 2 Drawing Sheets

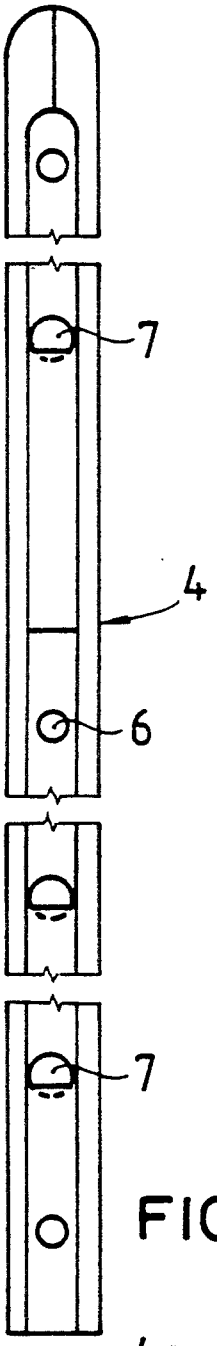
FIG. 3
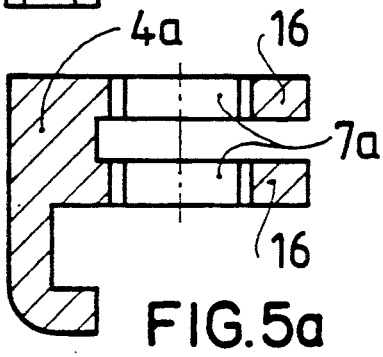
FIG. 5a
FIG. 4a
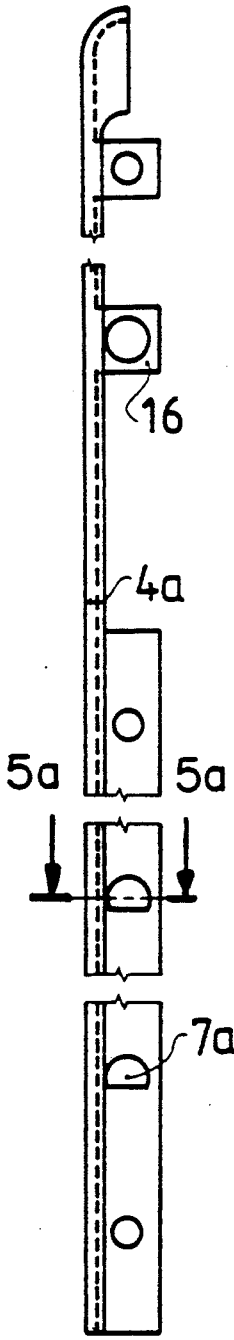
FIG. 4b
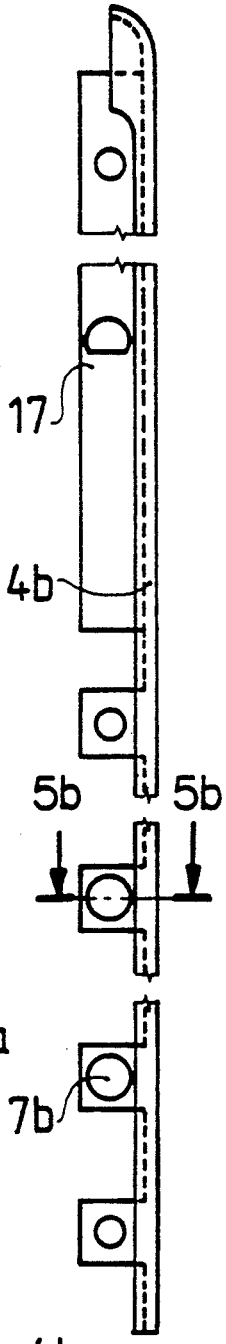
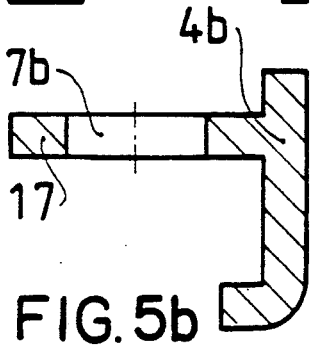
FIG. 5b

CRIB WITH POSITIONABLE AND SLIDING RAILINGS

BACKGROUND OF THE INVENTION

1. Field of the Invention

The invention relates to a crib for babies, provided with railings that are slideable in a vertical plane and positionable at different levels.

2. Description of Related Art

It is known from the state of the art to make cribs for babies using headboards generally produced from chipboard panels. On the inside of these headboards is a series of holes for receiving positioning pins arranged in the outer pieces of wood of the railings. The known positioning system has the drawback that the railing concerned cannot be easily and safely positioned at different levels and furthermore, it has been shown that those areas of the chipboard panels provided with positioning holes broaden undesirably with use because of the characteristics of the chip structure of the panels.

SUMMARY OF THE INVENTION

It is an object of the present invention to solve the drawbacks pertaining to the prior state of the art, by proposing a baby's bed with railings that are movable and positionable in a vertical plane and guarantee perfect sliding of the railings, as well as safe positioning of the railings at different levels, without running the risk of damaging the panels forming the headboards along the positioning areas. These objects are achieved according to the present invention by the fact that on each of the mutually confronting sides of the headboards, the headboards being intended to receive a sliding railing, a shaped slide bar is fixed, being provided with fixing holes and with holes receiving the end of a fixing rod movably accommodated in the outer solid piece of wood of the railing and pressed by a spring means toward the shaped bar for guiding and positioning, and in which the fixing rod has an operating knob at its free end.

With a bed provided with a shaped bar of this kind, damage to the chipboard panel near the positioning holes is avoided, the railing can be moved in a vertical plane with ease of sliding, and lastly, safe positioning of the railing at the desired level is guaranteed.

BRIEF DESCRIPTION OF THE DRAWINGS

The subject, designed according to the present invention, will now be described in greater detail and illustrated in the attached drawings, in which:

FIG. 3 the shaped bar in a front view, ready to be fitted;

FIGS. 4*a*, 4*b* show the shaped bar parts according to FIG. 3 in an exploded view; and FIGS. 5*a*, 5*b* show cross-sections of the shaped bar through the lines 5*a*—5*a* and 5*b*—5*b* of FIGS. 4*a* and 4*b*.

DETAILED DESCRIPTION OF THE PREFERRED EMBODIMENT

Figure 1:
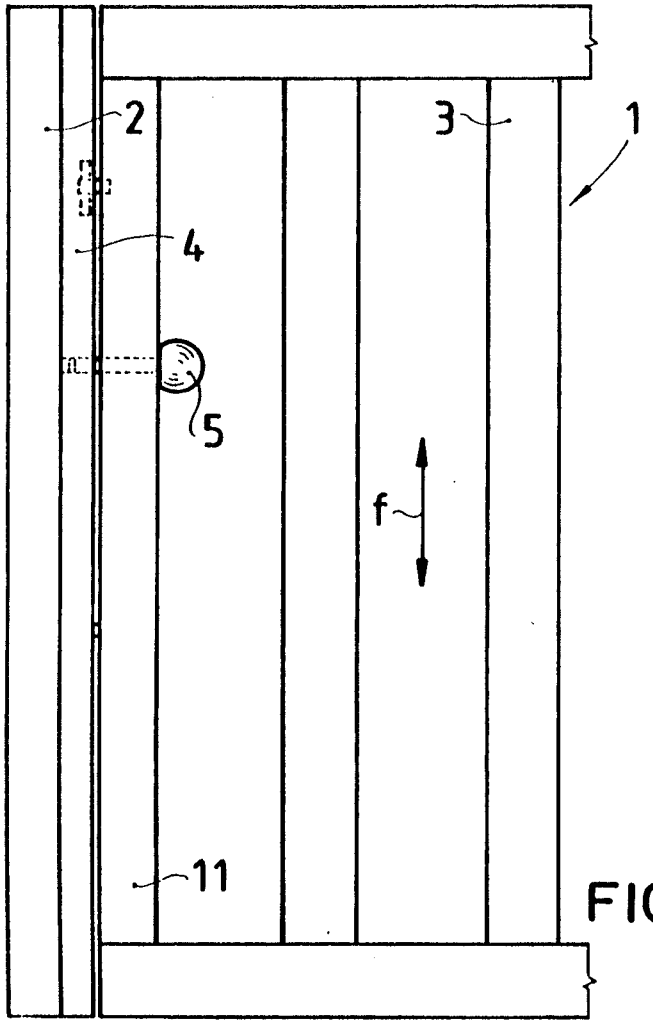
FIG. 1 in a front view shows the headboard of a crib with its corresponding railing.

As can be seen from FIG. 1, baby's cribs 1 generally consist of mutually confronting headboards 2 made using chipboard panels. Between the headboards 2 and on each side of the crib 1 a railing 3 is provided, made with pieces of solid wood.

Said railings 3 may be moved up and down in the manner indicated by the arrow f. In addition, the particular railing 3 is positionable at various levels of height.

To allow safe sliding of the railing 3 relative to the headboards 2, the latter have a shaped bar 4, made of synthetic material, on their mutually confronting sides.

A locking mechanism, indicated in FIG. 1 only diagrammatically by the operating knob 5, engages with the shaped bar 4.

Figure 2:
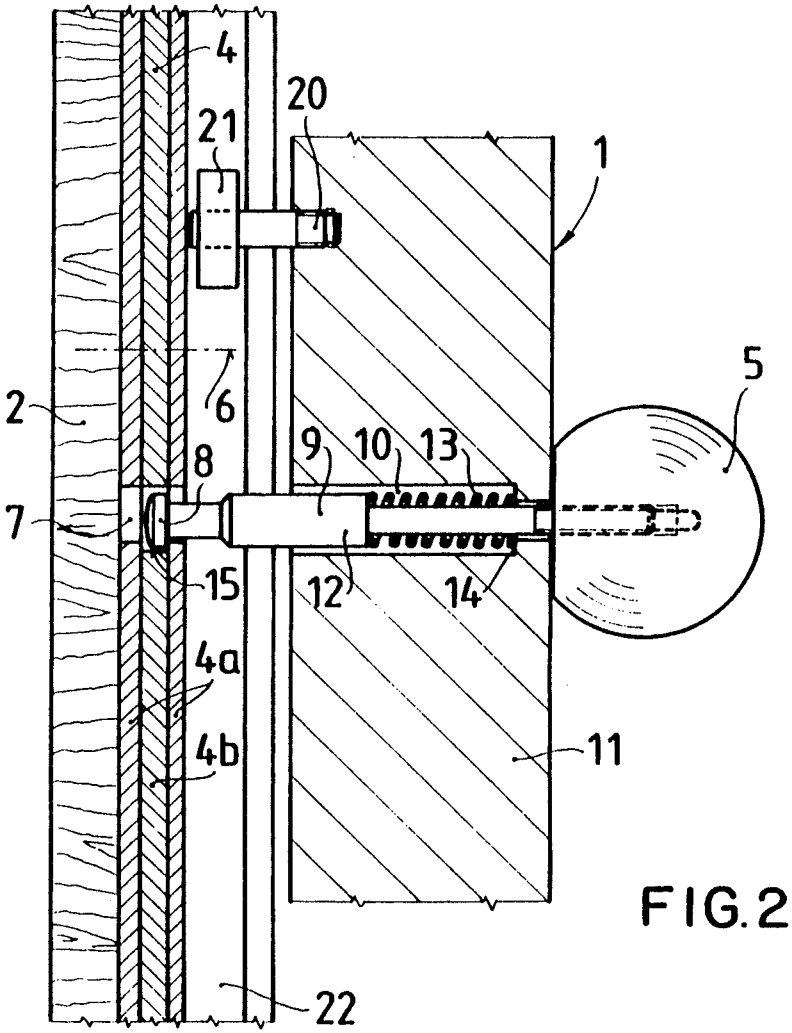
FIG. 2 shows the board, the shaped slide bar and the positioning mechanism in section.

From FIG. 2 it can be seen that the chipboard panel forming the headboards 2 receives the shaped bar 4 which is fixed to the panel 2 by the use of screws 6. The shaped bar 4 will be described in more detail below It is provided with a series of positioning holes 7 that receive the head 8 of a rod 9 whose free end receives the operating knob. The rod 9 is accommodated in a seat 10 made in the solid piece of wood 11 of the railing indicated by 1. The rod 9 has a thickened portion 12 that forms a stop for a spring means 13 that bears by its other end against the back 14 of the seat 10. The spring 13 is prestressed, so as to push the rod 9 with its head 8 permanently toward the shaped bar 4 and more precisely toward the holes for locking and positioning 7.

The shaped bar 4 is advantageously executed by the use of two shaped half-bars 4*a* and 4*b*. As may be seen from FIG. 2, the locking hole 7*b* made in the shaped half-bar 4*b* has a larger diameter than the hole 7*a* made in the shaped half-bar 4*a*. In this way a step 15 is created inside the hole 7 and enables a geometrical connection with the thickened head 8 of the rod 9.

This prevents the baby from deactivating the engagement of the head 8 of the rod 9 with the hole 7 of the shaped bar 4 by simply operating the knob 5. In order to disengage the head 8 of the rod 9 from the hole 7, it will be essential to raise the railing 3 slightly so that the process of disengagement can be carried out.

As may be seen from FIG. 3, the shaped bar for sliding and positioning has holes 6 to fix the bar to the chipboard panel 2. Also provided are positioning holes 7, with which the head 8 of the rod 9 of the locking device 8, 9, 10, which is work b knob 5, may be caused to engage. From FIGS. 4*a* and 4*b* it may be seen that the shaped bar, illustrated in an exploded front view, consists of two parts, that is of two shaped half-bars 4*a* and 4*b*.

The shaped half-bar 4*a* advantageously has twin-wall projections 16, to which single-wall projections 17 projecting from the shaped half-bar 4*b* may be connected The fact of making the shaped bar 4 in two parts 4*a* and 4*b* greatly facilitates the execution of the molding The shaped half-bars 4*a* and 4*b* are firmly united by the mutual connecting of the projections 16 and 17, and by subsequently adhesively bonding the shaped half-bars 4*a* and 4*b* a shaped bar is made that has a tough, rigid structure. The half-bars 4*a* and 4*b* are illustrated in detail in FIGS. 5*a* and 5*b*, showing the bars in a cross-section taken through the lines 5*a*—5*b* of FIGS. 4*a* and 4*b*.

Twin-wall limbs 16 project from the shaped bar 4*a*, and the limbs 17 projecting from the shaped bar 4*b* and made with a single wall may be connected thereto. By assembling the limbs 17 with the twin limbs 16 a precise geometrical connection is produced between the shaped half-bars 4*a* and 4*b*.

It is particularly advantageous for the through holes 7a made in the shaped half-bar 4a to be smaller than the holes 7b made in the limbs of the shaped bar 4b. By this expedient, after assembling the half-bars 4a and 4b a stepped hole 7 is created, as illustrated in FIG. 2. This difference in the sizes of the holes 7a and 7b made in the half-bar 4a and half-bar 4b enable the creation, after the definitive assembly of the half-bars 4a and 4b, of a stepped passage in the projecting limbs 16 and 17, with which stepped passage the thickened head 8 of the rod 9 is engaged in a geometrical connection.

As may be seen from FIG. 2 in particular, a rod 20 may be connected to the solid piece of wood 11 and receive at its free end a little sliding wheel 21 that slides in the channel 22 of the shaped bar 4. For this purpose, as may be seen more clearly from FIG. 5, the channel 22 is made in the shape of a C and receives the little sliding wheel 21. This gives perfect sliding of the railing 1 in its shaped bars 4.

Claim:

1. In a drop side crib, an arrangement for adjustably positioning an elongated railing that extends between spaced-apart bed frame members, said arrangement comprising:

(a) a pair of slide assemblies fixedly mounted on the frame members at opposite ends of the railing, each slide assembly including a pair of apertured slide bars, one of the bars having a first set of vertically spaced-apart apertures of a predetermined size, and the other of the bars having a second set of vertically spaced-apart apertures of a size smaller than said predetermined size, the first and second sets of apertures of each bar overlying each other to form stepped openings, the stepped openings of said one bar being at the same elevations as the stepped openings of said other bar; and (b) means for locking the railing on the frame members at a desired one of the elevations, including a locking pin at each end of the railing, and means for urging each locking pin in the stepped openings at said one elevation.

2. The arrangement according to claim 1 wherein each pin has an undercut head that engages a respective stepped opening.

3. The arrangement according to claim 2, wherein each end of the railing has a bore in which a respective pin is mounted, and wherein the urging means is a coil spring surrounding a respective pin within a respective bore.

4. The arrangement according to claim 1 wherein each of the first set of apertures is a circular opening, and wherein each of the second set of apertures is a semi-circular opening.

5. The arrangement according to claim 1, wherein each pin has an operating knob for enabling manual withdrawal of each pin from the stepped openings against the restoring action of the urging means.

6. The arrangement according to claim 1, wherein said one bar has a plurality of webs lying in a single plane; and wherein the first set of apertures extends through the webs.

7. The arrangement according to claim 6, wherein said other bar has a plurality of pairs of flange portions lying in a pair of planes; and wherein the second set of apertures extends through the pairs of flange portions; and wherein the webs are received between the pairs of flange portions.

8. The arrangement according to claim 1, wherein the bars of each slide assembly have track portions bounding a track, and wherein each slide assembly includes a roller mounted at each end of the railing, each roller rollably engaging a respective track.

9. The arrangement according to claim 1, wherein the bed frame members are constituted of chipboard wood panels, wherein the railing is constituted of solid wood, and wherein the bars are constituted of metal.

* * * * *